United States Patent [19]

Tuffier

[11] Patent Number: 4,458,618

[45] Date of Patent: Jul. 10, 1984

[54] SAFETY DEVICE FOR RENDERING A BOAT UNSINKABLE

[75] Inventor: François T. N. Tuffier, Paris, France

[73] Assignee: Rosa Tuffier nee Boubis, Paris, France; a part interest

[21] Appl. No.: 347,592

[22] Filed: Feb. 10, 1982

Related U.S. Application Data

[63] Continuation-in-part of Ser. No. 87,607, Oct. 23, 1979, abandoned.

[30] Foreign Application Priority Data

Oct. 23, 1978 [FR] France ..... 78 30059

[51] Int. Cl.[3] ..... B63B 43/10

[52] U.S. Cl. ..... 114/68; 114/360

[58] Field of Search ..... 114/68, 69, 348, 360

[56] References Cited

U.S. PATENT DOCUMENTS

| | | | |
|---|---|---|---|
| 644,480 | 2/1900 | de Villa | 114/68 |
| 1,170,095 | 2/1916 | Neumann | 114/68 |
| 1,320,012 | 10/1919 | Lee et al. | 114/68 |
| 1,736,155 | 11/1929 | Harter | 114/354 |
| 3,092,853 | 6/1963 | Owen | 114/68 |
| 3,324,816 | 6/1967 | Vogelsang | 114/68 |
| 3,340,842 | 9/1967 | Winslow | 114/68 |

FOREIGN PATENT DOCUMENTS

| | | | |
|---|---|---|---|
| 2525202 | 12/1976 | Fed. Rep. of Germany | 114/348 |
| 1423010 | 11/1965 | France | 114/360 |

*Primary Examiner*—F. J. Bartuska

*Attorney, Agent, or Firm*—Sughrue, Mion, Zinn, Macpeak and Seas

[57] ABSTRACT

The device renders unsinkable a boat such as a habitable boat having a cabin and a cockpit. The device comprises three inflatable envelopes two of which are placed on starboard side and port side bunks respectively whereas the other envelope is placed on the floor of the cabin between the two bunks. A compressed gas container controlled by a valve is connected to all the envelopes for inflating the envelopes when required.

10 Claims, 10 Drawing Figures

SAFETY DEVICE FOR RENDERING A BOAT UNSINKABLE

This application is a Continuation-In-Part of U.S. patent application Ser. No. 87,607, filed on Oct. 23, 1979 now abandoned.

The present invention relates to a safety device for rendering unsinkable a boat, in particular a habitable boat having a cabin and cockpit.

It is known to employ elements which are inflated or have closed cells for rendering small boats unsinkable. However, this method is not applicable to habitable boats since, in order to render the boat unsinkable, these elements would occupy a volume incompatible with the relatively restricted space available on board such habitable boats.

As most habitable boats are consequently not unsinkable, they usually have on board a survival tender equipped with means for automatically inflating it when placed on the water, the presence of this tender being even obligatory on board all habitable boats according to certain national regulations. However, from the safety point of view, the survival tender is not a fully satisfactory solution, in particular in the case of small habitable boats, for example those having a length of 6 to 8 meters and in particular sailing boats. Indeed, such small boats usually have little room available on the deck for fixing the survival tender to the latter. Consequently, it is often necessary to place them in not very suitable regions, such as at the foot of the mast on sailing boats. Apart from the hinderance of such a position of the survival tender when maneuvring, it has the serious drawback of being practically inaccessible to the crew in the case of the capsizing of the boat. A number of accidents have moreover shown that this danger was not merely theoretical since some boats have sunk without the crew having been able to release the survival tender owing to a capsizing or to the fact of receiving a breaker wave. Further, survival tenders are unreliable and there have been many examples of survival tenders which, when thrown in the water, have immediately sunk without inflating.

Consequently, an object of the invention is to provide a safety device for rendering a boat unsinkable which avoids the drawbacks of known solutions.

The invention provides a safety device, in particular for a habitable boat having a cabin and cockpit, said device comprising at least one inflatable planar envelope disposed in a part of the inner volume of the hull of the boat which is devoid of obstacles which might oppose the inflation of said envelope, at least one normally closed source of gas under pressure connected to said envelope, and means for actuating said source of gas for controlling the inflation of said envelope.

According to one feature of the invention, said inflatable envelope is an envelope folded in the form of an accordeon.

According to another feature of the invention, said device comprises a plurality of inflatable envelopes disposed in substantially symmetrical places of the hull of the boat.

These devices are particularly appropriate for ensuring that the boats are unsinkable and for effectively maintaining them on the surface of the water.

However, whenever the completely or partially immersed boat is in an inclined or capsized position, the inflatable envelopes fixed inside the hull cause the boat to rise to the surface but in a position overturned to about 90°.

A further object of the invention is to provide an improvement in the device according to the invention whose function is to right the boat and return it roughly to its water lines, bearing in mind of course the increase in its weight due to the mass of water that it might still contain.

The invention therefore also provides a safety device of the aforementioned type comprising a plurality of envelopes at least one of which is disposed on the floor of the cabin between the bunks, wherein said envelope disposed between the bunks is secured to the floor in a undetachable manner by rigid means as close as possible to the centre of gravity of the boat, each of said envelopes disposed at substantially symmetrical positions being connected, on one hand, to the surface of the benches or bunks by releasable means and, on the other hand, against the hull of the boat by guiding means which enable the envelopes to slide alongside the hull to a limited extent.

According to another feature of the invention, said releasable means are adapted to separate under the action of the thrust exerted by the immersed inflated envelope.

According to a further feature of the invention, said guide means comprise straps disposed at least at three points which are spaced apart along the length of the envelope and which connect the envelope to the hull at points which are spaced laterally as far as possible away from the longitudinal axis of the boat and above the centre of gravity of the boat.

It will be understood that, with this arrangement, when the boat has capsized to a position of roughly 90°, the envelope or the envelopes which are located on the immersed side detach themselves from their supports and, as they are maintained against the hull, exert a pull on the straps which maintain them against the lowermost part of the hull, thus creating a moment about the centre of gravity which rights the boat.

Further features and advantages of the invention will be apparent from the ensuing description of an embodiment of the invention which is given solely by way of example and illustrated in the accompanying drawing in which.

Figure 2:
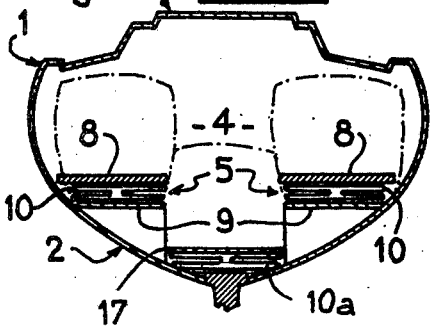
FIG. 2 is a sectional view taken on line 2—2 of FIG. 1.
Figure 3:
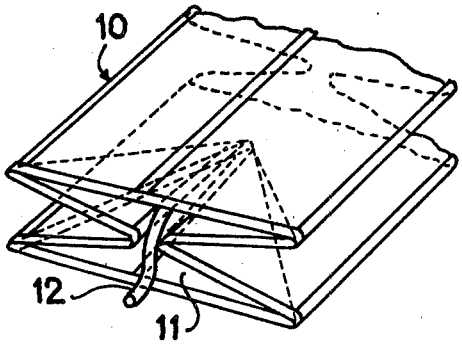
FIG. 3 is a perspective view, to an enlarged scale, of an inflatable envelope of the device according to the invention shown in the deflated state.
Figure 1:
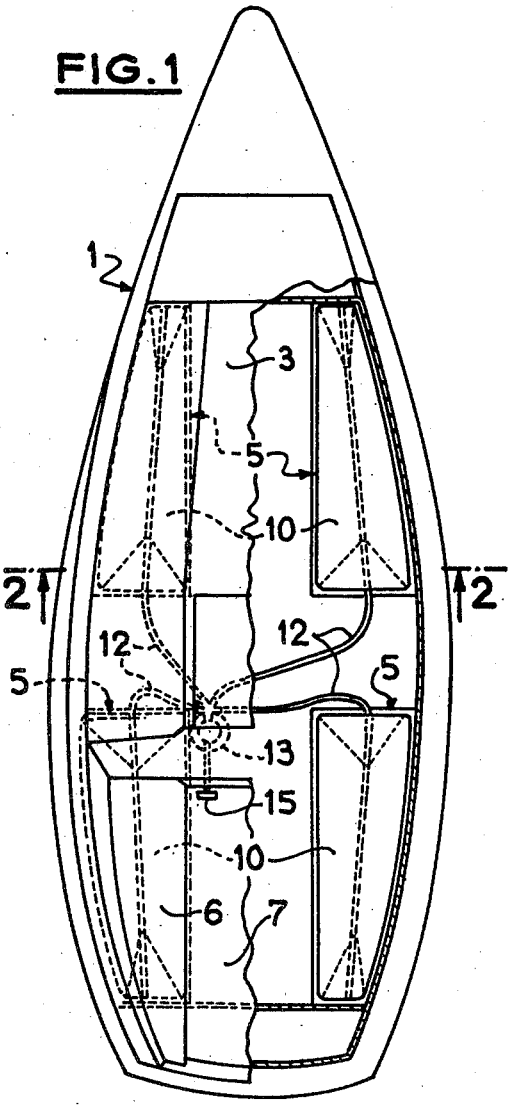
FIG. 1 is a diagrammatic plan view, with a part cutaway, of a boat equipped with a safety device according to the invention.

With reference first to FIGS. 1 and 2, the latter show a sailing boat 1 only the parts of which necessary to the comprehension of the invention have been shown. This boat 1 comprises a hull 2 and a roof 3 defining a cabin 4 in which four bunks or berths are provided. The bunks 5 define horizontal upper surfaces and are disposed symmetrically in the hull 2, two of these bunks being disposed in the front part of the hull and two in the rear part under the seats 6 of a cockpit 7. Disposed between the mattress 8 of each bunk 5 and the panel 9 on which this mattress rests is an inflatable envelope 10 of planar shape and folded in the form of an accordeon, shown in more detail in FIG. 3. Preferably, each inflatable envelope 10 is secured by its lower side 11 to the panel 9 by any suitable means such as by adhesion. The inflatable envelopes 10 may be made from any suitable rubberized or rubbery material, for example the material of which inflatable dinghies are made, and each of them is connected by a flexible pipe 12 to a source of gas under pressure, or gas supply means, 13 provided with a coupling 14. Preferably, the source of gas 13, for example $CO_2$, under pressure, is located in the vicinity of the descent hatchway giving access to the cabin, inside the latter, and it is connected to a control handle 15, which is disposed in the cockpit 7, by a cable 16 or the like which passes through the wall of the cockpit 7 adjacent to the descent hatchway.

Figure 4:
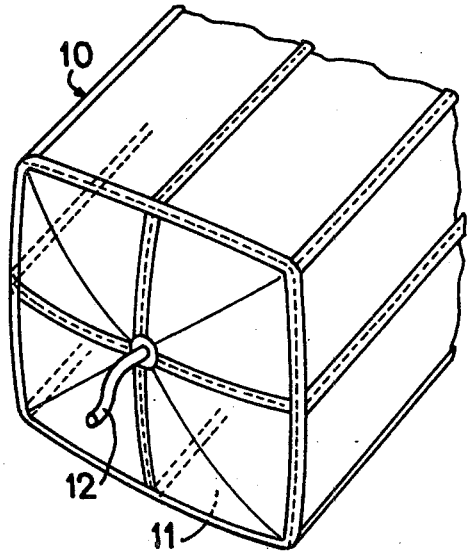
FIG. 4 is a view of the envelope of FIG. 3 shown in the inflated state.
Figure 5:
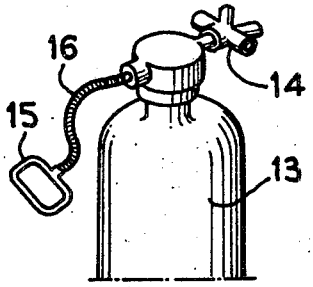
FIG. 5 is a perspective view of the source of gas under pressure and actuating means for inflating the inflatable envelopes of the device according to the invention.

Under the normal conditions of use of the boat, that is to say when its floatability is not in danger, the inflatable envelopes 10 remain in the deflated state. It can be seen that they then occupy only an extremely small volume and that the device in no way adversely affects the habitability of the boat. On the other hand, if an accident occurs, such as the capsizing of the boat or the fact that a breaker wave breaks over the boat and fills the cabin of the latter, the crew can very easily and immediately ensure its safety by acting on the handle 15 which causes the inflation of the envelopes 10 by the source of pressure 13. The envelopes 10 then assume the configuration shown in dot-dash lines in FIG. 2 and in more detail in FIG. 4.

It will be seen that the disposition of the envelopes 10 in judiciously chosen places such as the bunks of the boat above which there is always provided a large volume of free space, enables inflatable envelopes to be used which, in the inflated state, have a large volume capable of ensuring that the boat floats even if it is completely filled with water. By way of example, with inflatable envelopes having a section of about 2800 sq.cm in the inflated state, three inflatable envelopes having a length of 1.50 meters cause the floating of a boat of about 1000 to 1200 kg, three inflatable envelopes of 1.80 meters length the floating of a boat of about 1300 to 1600 kg and four inflatable envelopes of 1.80 length the floating of a boat of about 1700 to 2600 kg. The gas of the source under pressure may be for example carbon dioxide or any other suitable inert gas.

It will be understood that many modifications may be made in the embodiment described hereinbefore without departing from the scope of the invention. Thus for example the envelopes 10 may be placed elsewhere than on the bench seats or bunks, for example on the floor of the cabin or both on the floor as shown at 10*a* in FIG. 2, and on the bunks if necessary. In the case of use on a floor, the inflatable envelope or volume element is preferably covered on its upper side with a nylon pile carpet 17. Further, all the envelopes 10 may be connected to the same supply means or source of gas under pressure so as to be simultaneously inflated, or a number of sources of gases under pressure may be provided to each of which one or more inflatable envelopes are connected. It is also possible to contemplate the disposition of the means for actuating the source of gas under pressure elsewhere than in the cockpit and the construction thereof in some other form, for example in the form of a device which operates automatically in response to the presence of water or pressure. It is not necessary that the envelopes 10 be fixed to the surface on which they rest. However, this fixing has the advantage of retaining them near the bottom of the boat, when they are inflated and the boat is filled with water, so that their effectiveness is enhanced in this situation.

There will now be described particular advantageous arrangements for attaching the various envelopes to the hull of the boat.

Figure 6:
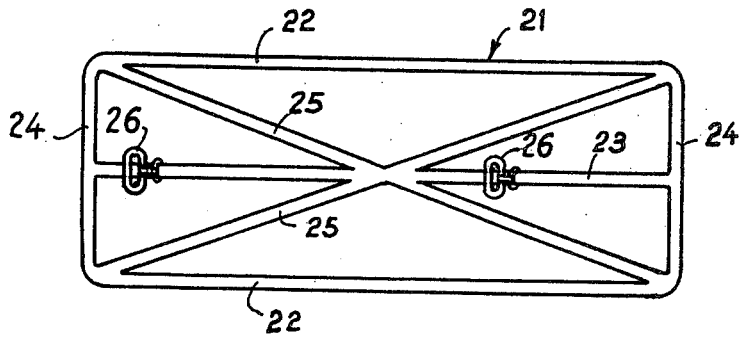
FIG. 6 is a plan view of a metal frame for fixing an inflatable envelope to the bottom of the boat.
Figure 7:
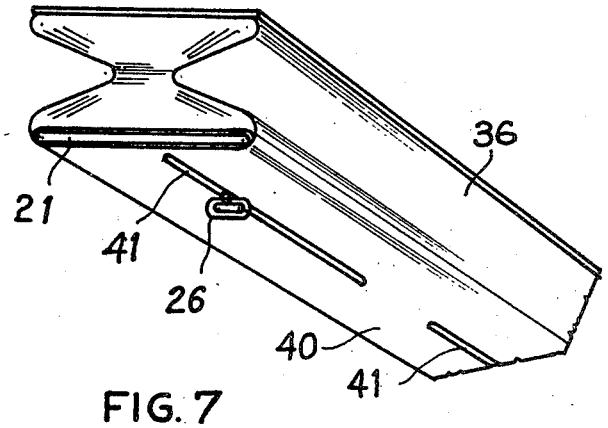
FIG. 7 is a perspective view of the bottom of the envelope adapted to be fixed in a central position, showing the pocket for fixing the envelope to the frame.
Figure 9:
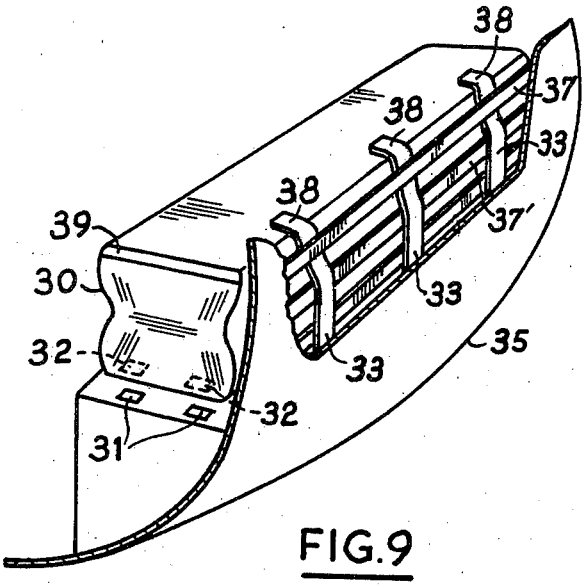
FIG. 9 is a diagrammatic partial perspective view of the means for releasably connecting an inflated envelope to the surface of a bunk and the means for guiding said envelope alongside the hull.
Figure 8:
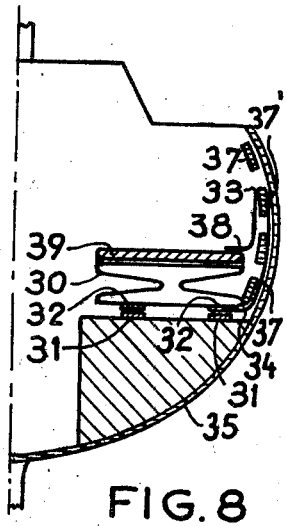
FIG. 8 is a diagrammatic sectional view showing the arrangement of the means for guiding an envelope, which latter is in course of inflation.

With reference to FIG. 6, there is shown a metal frame 21, which has a roughly rectangular shape and comprises two lateral longitudinal members 22, a central longitudinal member 23, two cross-members 24 and two bracing members 25 disposed diagonally.

At least two flat metal rings 6 are slidably mounted on the median longitudinal member 23 and are adapted to fix the frame, for example to tabs fixed to the keel bolts or screw-spikes, or to the boat hoisting ring, so as to maintain the frame rigidly in a position as close as possible to the centre of gravity of the boat.

The frame 21 is adapted to fix an inflatable envelope 36 on the longitudinal axis of the boat also as close as possible to the centre of gravity of the boat.

This inflatable envelope, which is folded in the form of an accordeon as described hereinbefore in respect of the envelopes 10, comprises on its lower side a double bottom 40 defining a pocket extending throughout the area of the envelope. The rigid metal frame 21 is slipped into the pocket and slots 41 are formed in the double bottom 40 so as to correspond with the longitudinal member 23 and allow the passage of the rings 26 and the adjustment of their position along this longitudinal member in facing relation to the bolts or screw-spikes.

It will be understood that the rings 26, which are adjustable along the median longitudinal member 23, enable the frame 21 to be fixed, by an adjustment thereof in the longitudinal direction, in the appropriate position.

It will also be understood that other frames may be fixed in the bottom of the hull of the boat one behind the other. Their shape may also be adapted to that of the available space and are consequently not necessarily rectangular.

According to another feature of the invention, the lateral inflatable envelopes 30 in the form of an accordeon as described hereinbefore in respect of the envelopes 10, constitute guided movable elements which have a stabilizing and righting effect on the boat in the case of a capsizing of the latter at 90°. For this purpose, they each comprise, on one hand, on their lower surface, a number of Velcro elements 31 which cooperate, in the inflated condition of the envelope 30, with complementary Velcro elements 32 secured to the upper wall of the bench seat or bunk and, on the other hand, at least three straps 33 each of which is fixed by one end 34 to a corresponding point of the lower side of the envelope and which extend upwardly between the hull 35 and retaining means, namely conventional strips 37 fixed along the hull in the presently-described embodiment, and are folded over an upper strip 37' and redescend on the other side toward the interior, their opposite end 18 being fixed to a corresponding point of the upper surface of the envelope 30.

It will be understood that in the absence of the strips 37, or in the case where their arrangement would not permit the passage of the straps 33 therebetween and the hull 35, there may be provided flat rings or buckles (not shown) which are for example fixed to the athwart ribs.

Advantageously the mattress 39 of each bunk may be detachably secured to the upper wall of the envelope 30, for example by means of pieces of Velcro.

Figure 10:
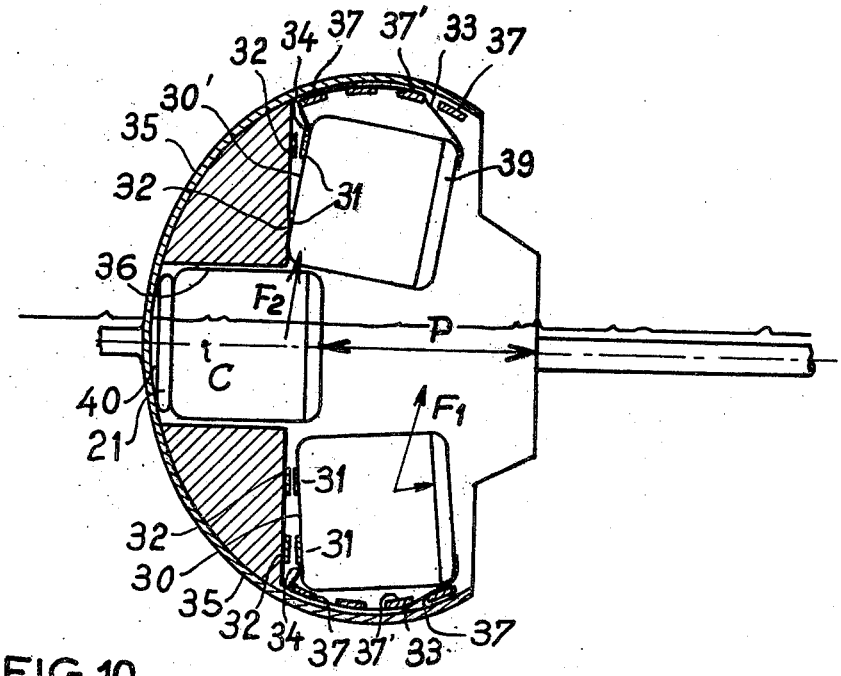
FIG. 10 is a diagrammatic sectional view of a boat which has capsized to about 90°, showing the rightening moment created by the device according to the invention.

Note that the volume of the central envelope 36 is so calculated that, in the inflated state, it always leaves thereabove a passage of such height as to permit access to the front part of the boat as indicated at P in FIG. 10, when the boat has been righted.

With reference to FIG. 10, there has been shown diagrammatically a boat equipped with the device according to the invention (this boat having capsized at roughly 90°)at the moment when the device has just brought it back to the surface and assuming that the action of the guided stabilising and straightening elements has not yet occurred (which is purely theoretical since this action is in fact immediate as soon as they are inflated).

The two lateral envelopes 30 and 30' have been inflated by the opening of the source of gas under pressure as described hereinbefore, the same being true of the central inflatable envelope 36 which is maintained close to the centre of gravity by the rigid frame 21.

Bearing in mind the position of the boat, the immersed envelope 30, after having been inflated, has exerted sufficient traction on its releasable fixing devices 31, 32 to detach itself from the surface of the bunk or seat. The thrust due to the floatability of the inflated envelope 30 tends to cause the latter to rise to the surface. As the straps 33 retain the inflated envelope in a slidable manner against the strips 31, and consequently practically against the hull 35, this envelope places itself against the deck beams and exerts a tensile force which is solely transmitted to the hull through the straps 33 and which tends to create a moment of rotation about the centre of gravity C roughly in the direction of arrow F1, this moment tending to turn the boat upright.

This thrust F1 is added to the upward thrust exerted by the envelope 36 roughly in the direction of F2.

It will be understood that, as the straps 33 connect the envelopes 30 to the hull of the boat at at least three points of their length, these envelopes can neither fold nor escape from the roof by way of the door of the latter and that the thrust F1 is consequently transmitted to the hull throughout their length.

If the boat sinks before the inflation of all the envelopes, the envelope 30' may of course also become detached from its releasable fixing means 31, 32 and place itself against the walls and thus contribute to the righting moment exerted around the centre of gravity.

It is important to note that the action of the straps 33 which results from the inflation of the envelopes 30, 30' is sufficient to guide the envelopes in a slidable manner and enable them to approach the deck beams when they are inflated so that they move still further away from the centre of gravity C, which increases the boat righting moment while transmitting their thrust to the hull. However, this action is insufficient to result in this thrust being transmitted to the deck beams if the boat sinks without overturning for otherwise the deck beams would not resist this thrust.

To achieve this result, there must be suitably chosen not only the length of the strap but also the height of the upper strip 37' or other retaining means over which the strap passes.

As soon as the straightening of the boat has started, the weight of the keel exerts an increasing action. Trials have shown that the righting and balancing effect of the envelopes was immediate and extremely powerful.

Having now described my invention what I claim as new and desire to secure by Letters Patent is:

1. A safety device in combination with a boat which comprises a hull, a cabin, a cabin floor, means defining a bunk or bench seat having an upwardly facing horizontal surface on the starboard side of the cabin and means defining a bunk or bench seat having an upwardly facing horizontal surface on the port side of the cabin, said bunks defining a centre passageway which extends from said horizontal surfaces down to said floor, said device comprising at least three inflatable envelopes two of which envelopes are placed on said two surfaces whereas the third envelope is placed in said passageway on the floor transversely centrally of said hull, inflating gas supply means, passage means putting the supply means in communication with the envelopes and actuating means associated with the gas supply means for inflating the envelopes when desired, said inflatable envelopes being folded in the manner of an accordeon when deflated and located in parts of the cabin which are devoid of obstacles liable to oppose the inflation of the envelopes, said two envelopes being disposed in positions of the hull of the boat which are substantially symmetrical relative to a longitudinal axis of the boat, rigid means for fixing said third envelope in an undetachable manner to said floor as close as possible to the centre of gravity of the boat, said two envelopes constituting boat righting and stabilising movable envelopes, releasable means for connecting said two envelopes to the horizontal surfaces of the respective bunks, and guide means for guidingly connecting said two envelopes to said hull and allowing said two envelopes a limited movement away from said horizontal surfaces alongside said hull.

2. A device according to claim 1, wherein said releasable means comprise two elements which are adapted to separate under the action of the thrust exerted by the corresponding envelope when the corresponding envelope is inflated and is immersed in water.

3. A device according to claim 2, wherein said releasable means comprise elements of Velcro.

4. A device according to claim 1, wherein said guide means comprise belts which are disposed at at least three regions of the corresponding envelope spaced apart longitudinally of the boat and connected to the envelope, said belts being slidably mounted on said hull at points which are spaced as far as possible laterally away from the centre of gravity of the boat and above said centre of gravity.

5. A device as claimed in claim 4, comprising retaining means mounted on said hull to be spaced from said hull, said straps being each fixed by one end thereof to a lower surface of the respective envelope and by an opposite end thereof to an upper surface of the respective envelope and disposed in such manner as to extend slidably between said retaining means and said hull.

6. A device as claimed in claim 5, wherein the position in height of said retaining means on said hull and the length of said belts are such that the respective envelope is slidable alongside the hull while being guided against the hull without coming into contact with a roof of said cabin.

7. A device as claimed in claim 1, wherein said rigid means for fixing said third envelope to said floor comprise a metal frame including connecting means which are adjustable longitudinally of said frame and connect said frame to said floor.

8. A device as claimed in claim 7, wherein said third envelope comprises a double bottom which defines a pocket for receiving said rigid frame and defines slots through which slots said connecting means extend.

9. A device as claimed in claim 7, wherein said connecting means are rings which are slidable along a longitudinally extending member of said frame.

10. A device as claimed in claim 1, wherein said third envelope has such dimensions that, when it is inflated, it defines thereabove a sufficient height of free space to permit the passage of a man.

* * * * *